United States Patent [19]

Von Canon et al.

[11] 4,351,118

[45] Sep. 28, 1982

[54] APPARATUS AND METHOD FOR CONTINUOUSLY TREATING YARN

[76] Inventors: George Y. Von Canon, 205 Red Riding Hood Trail; Aubrey C. Hobbs, 1308 Cinderella Rd., both of Lookout Mountain, Tenn. 37350

[21] Appl. No.: 239,022

[22] Filed: Feb. 27, 1981

[51] Int. Cl.[3] ..... D06B 3/06

[52] U.S. Cl. ..... 34/24; 8/149.3; 28/281; 34/85; 68/5 D; 118/68

[58] Field of Search ..... 8/149.1, 149.3; 68/5 D, 68/5 E; 34/24, 85; 118/67, 68; 28/281

[56] References Cited

U.S. PATENT DOCUMENTS

| | | | |
|---|---|---|---|
| 3,426,553 | 2/1969 | Erb | 68/5 D |
| 3,683,650 | 8/1972 | Hirschburger | 68/5 D |
| 3,774,384 | 11/1973 | Richter | 68/5 D X |
| 3,817,061 | 6/1974 | Bruner | 68/5 D |
| 4,096,714 | 6/1978 | Nirenberg | 68/5 C |

*Primary Examiner*—Philip R. Coe

*Attorney, Agent, or Firm*—Thomas E. Beall, Jr.

[57] ABSTRACT

Indefinite strand yarn is steam and heat treated in an enclosure. The yarn travels in an indefinite length moving coil through a tunnel that extends through the enclosure, with steam being supplied to the enclosure and the exhaust pipes leading from adjacent the inlet and outlet of the tunnel to a blower for exhaust to the exterior of the enclosure. Periodically, the buildup of yarn filaments and partially solidified condensate on the interior surfaces are removed by spraying liquid solvent along such surfaces, preferably with nozzles that spray solid cones of liquid solvent axially down the various pipes and automatic timed controls for sequencing such spraying.

17 Claims, 9 Drawing Figures

APPARATUS AND METHOD FOR CONTINUOUSLY TREATING YARN

BACKGROUND OF THE INVENTION

Yarn is useful in constructing many articles, for example yarn that is used in the tufting industry for the tufting of carpets. Prior to its use, it is desirable to heat treat and set the yarn.

In making yarn, fibers are arranged parallel to each other by machinery and drawn into rather bulky loose strands, which are repeatedly twisted, lengthened for further straightening and orienting the fibers parallel to each other, and combining of strands. During this process, the yarn filaments or strands are pulled relative to each other, untangled, and operated upon at increasing speeds by machinery, so that it has become the practice to treat the strands, particularly synthetic fibers that do not have natural oils, with lubricating oils to facilitate relative movement of strands and to further treat them with anti-static agents to further facilitate their movement with respect to each other and with respect to the machinery operating upon them.

In recent years, a plurality of various pressure and heat treating machinery, with corresponding spooling and unspooling devices have been replaced by a single machine that can operate upon a plurality of yarn strands coming from the above-mentioned treatment to process the yarn prior to its dyeing or use. In this apparatus, the yarn is heat treated at relatively high temperatures with steam. This steam treatment vaporizes and drives off the various working fluids, such as lubricating oils and anti-static liquids that are on the yarn when the yarn enters the apparatus. These vapors then condense on the surfaces that they come in contact with or are completely exhausted. For exhausting the spent steam, various pipes and a blower are provided, which structure forms surfaces that will condense the vapors. Some of the condensate forms a mat-like mass with the unavoidably present airborn yarn filament pieces and the condensate at least partially solidifies at the high temperatures within the apparatus. This mat progressively reduces the through flow cross sectional areas of the pipes removing the spent steam, to produce pressure losses causing increased difficulty in removing the spent steam, increased difficulty in maintaining the temperature for the yarn treatment, which is critical, and increasing temperature and pressure variations throughout the system over what is desirable.

It has been the practice in the past to disassemble the blower and all the pipes providing for the removal of the spent steam and remove the mats on their interior surfaces by hand scraping, high pressure fluids, and the like at a location remote from the treating apparatus. Further, it has been the practice to place small men within the enclosure of the apparatus to scrape the interior surfaces. It is common to operate this machine 24 hours a day, 7 days a week, except for maintenance. The above described cleaning operation is usually done between each week and each month, and it takes approximately 8 hours for a multi-person crew to perform each cleaning.

Examples of yarn treating machines are disclosed in U.S. Pat. No. 3,426,553 and U.S. Pat. No. 3,683,650.

SUMMARY OF THE INVENTION

The present invention relates to strand yarn processing apparatus that heat treats the yarn on a continuous basis with steam.

The spent steam is removed from adjacent the inlet and outlet of a plurality of tunnels that lead through, and parallel, a heated insulated enclosure. Each tunnel is provided with a cantilevered beam having a moving yarn support surface on which is coiled the yarn in a continuous manner at one end for its withdrawal at the other end of the tunnel. While on the moving coil within the tunnel, the yarn is heat treated with steam. Condensed and partially solidified working liquids removed from the yarn by the heat treatment and attached yarn filament pieces that form a mat are periodically removed from the interior surfaces of the apparatus, in situ, with solvent spraying.

It is preferable to have the solvent spraying conducted by means of nozzles mounted throughout the system, with nozzles associated axially symmetrical with respect to various pipes for spraying a solid cone of liquid solvent axially down the corresponding pipes so as to contact substantially the entire inner surface of each pipe with solvent liquid to remove the mat. The apparatus and cleaning steps are preferably conducted automatically.

Thereby, the objects of the present invention, relating specifically to such machinery, are to operate such yarn heat treating machinery more efficiently, with less maintenance, with less maintenance cost, with less maintenance down time, with improved temperature control, with improved pressure and temperature distribution throughout the apparatus, with reduced energy for spent steam removal, with less labor to perform the maintenance, and less idle time for the machine operators while the maintenance is being conducted.

BRIEF DESCRIPTION OF THE DRAWING

Further objects, features and advantages of the present invention will become more clear from the following detailed description of a preferred embodiment, with respect to the accompanying drawings, which shows.

DETAILED DESCRIPTION

Figure 1:
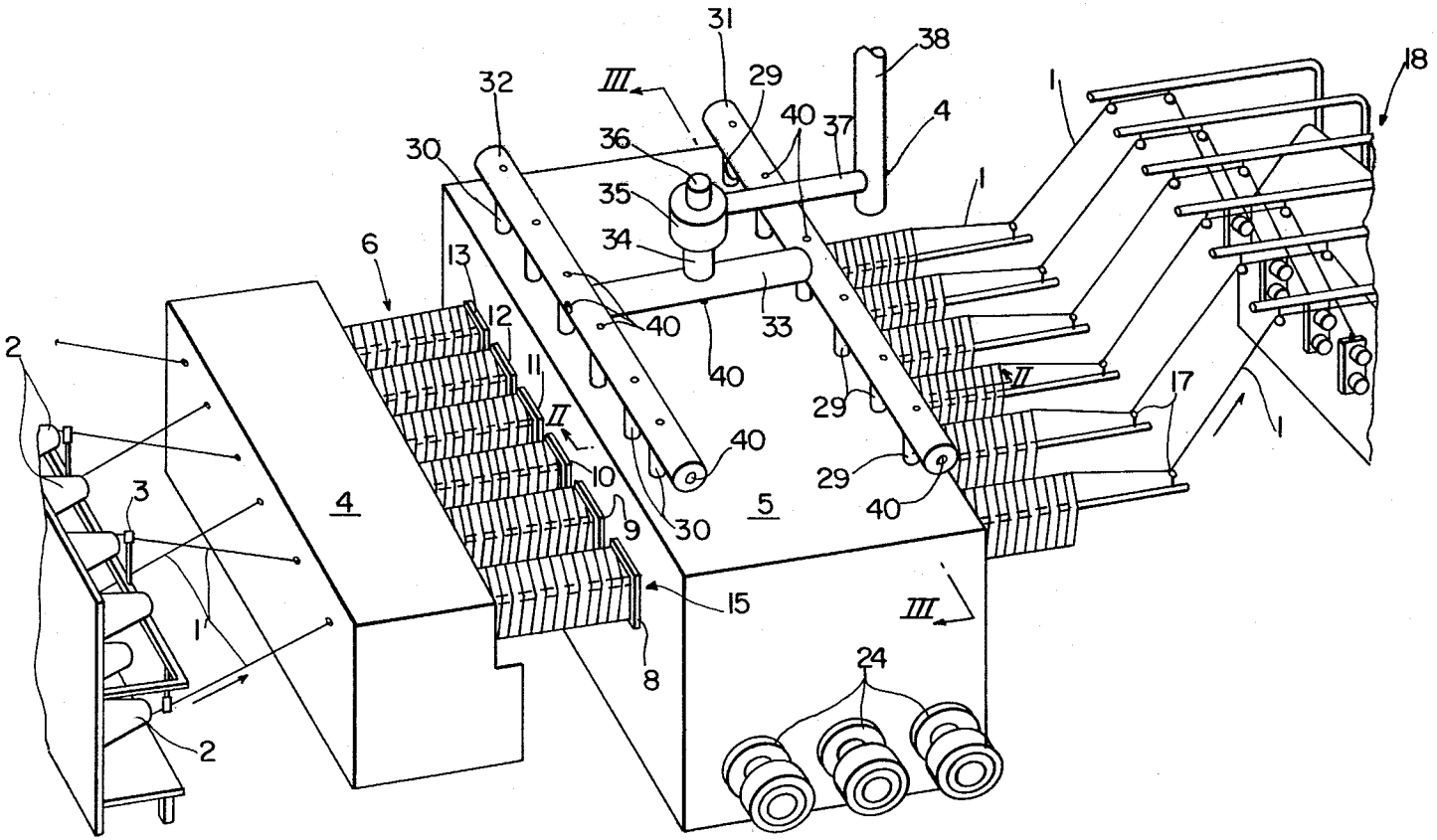
FIG. 1 is a perspective view, from the top, of yarn steam processing apparatus employing the features of the present invention.

With respect to the apparatus shown in FIG. 1, yarn 1 that has been manufactured and temporarily stored on spools 2 is pulled from its coiled condition on the spools 2 through a stationary guide 3 and into a coiling apparatus, of known construction 4. The coiling apparatus 4 may be of the type shown in U.S. Pat. No. 3,683,650 and referred to as a winding head. The disclosure of this patent is incorporated herein in its entirety, with respect to the structure of the winding head, the enclosure 5, and a traveling surface beam 6.

Figure 2:
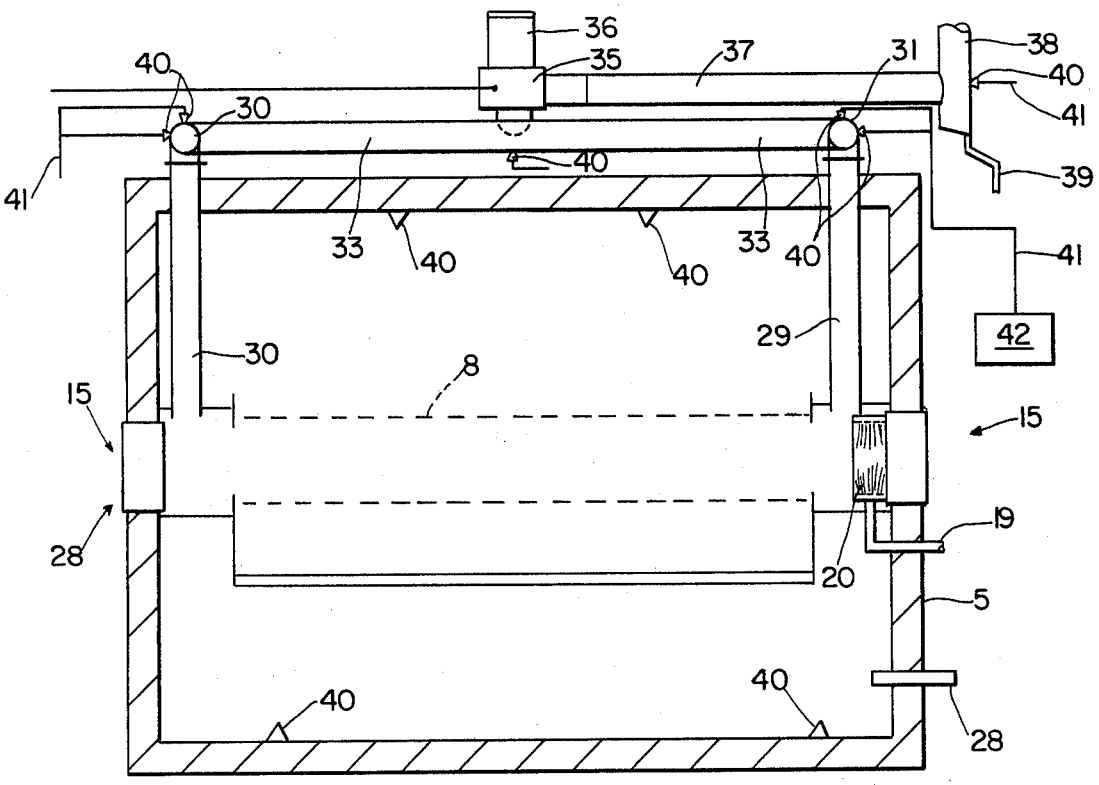
FIG. 2 is an elevation side view, in cross section, taken along line II—II of FIG. 1.
Figure 3:
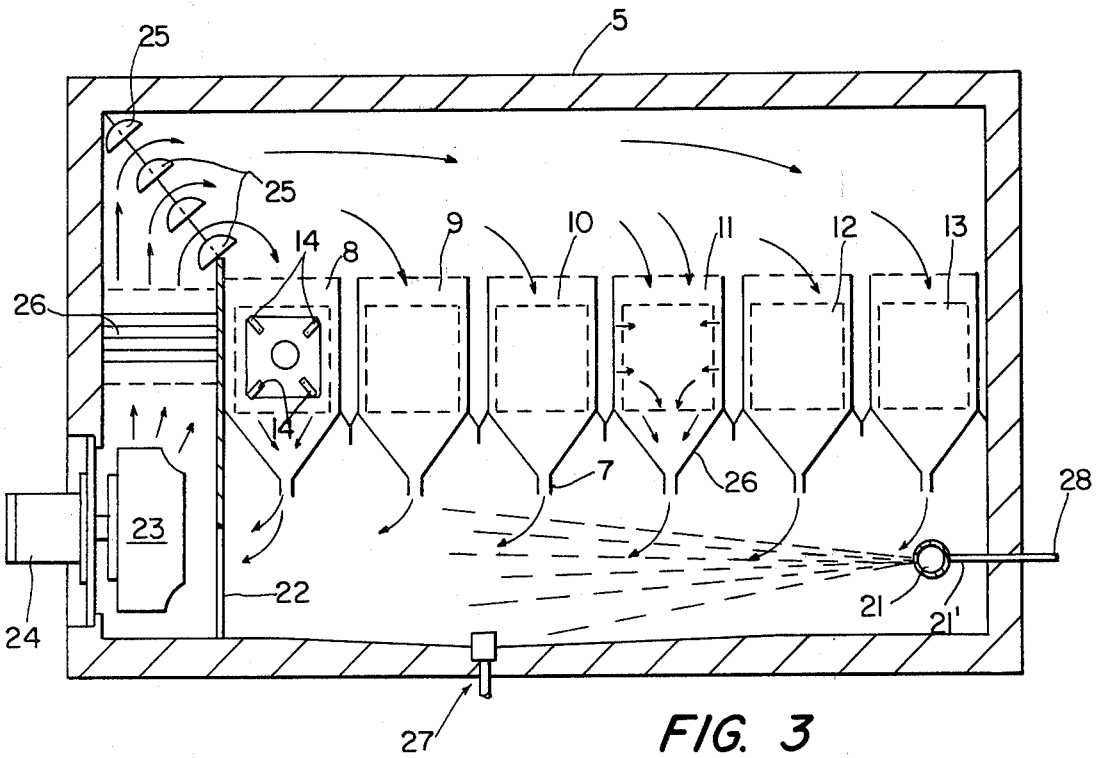
FIG. 3 is an elevation end view, in cross section, taken along line III—III of FIG. 1.

As seen in FIGS. 2 and 3, the enclosure 5 is basically of a box shape, with thick heat insulated walls forming four sides, a top, and a bottom. There are six tunnels passing horizontally and parallel to each other completely through the enclosure 5, with such tunnels being shown in the drawing at 8, 9, 10, 11, 12, and 13, respectively. There is a beam 6 passing through each one of the tunnels 8–13, with the beam being supported within the coiling machine 4 in a cantilevered manner and being provided with a continuously moving outer surface, moving in the direction from left to right in FIG. 1 in an endless manner. This surface is specifically formed by four endless belts 14 respectively at the four corners of each beam, to thereby form a box beam. Each endless belt travels within a plane, with opposed pairs of belts being in the same plane to thereby form two planes intersecting each other at right angles along the diagonals of the box beam cross section as shown in FIG. 3. Thereby, each endless belt 14 is provided with one exterior belt run and one return interior belt run, with the exterior belt runs all moving in the same direction from left to right as shown in FIG. 1.

The coiling apparatus 4 coils the strand yarn in a coil on the moving beam, which coil then travels with the moving beam through the enclosure 5 to the exterior of the enclosure, with each coil traveling in a respective tunnel. Each tunnel is provided with an inlet end 15 and an outlet end 16. To simplify the drawing, the coil and beam are not shown in FIG. 2, and only shown in the tunnel 8 in FIG. 3. At the outlet end of each tunnel, exteriorly of the enclosure 5, the yarn strand that was treated in the enclosure 5 is withdrawn by being pulled through a stationary guide 17 to feed and tension rolls 18, from where the six strands of yarn are fed to some utilization device continuously, such as a rug tufting machine, or to a spooling device that will place each strand of yarn on a spool for further storage.

Within the enclosure 5, the tunnels are constructed basically as porous or perforated conduits having their opposite ends mounted in apertures within opposed walls of the enclosure. At the entrance end of the tunnel, there is a steam envelope 20, which extends for a short portion of the length of the tunnel, but completely around the moving coil of yarn, to provide an additional blast of steam to the yarn. A steam pipe 19 is connected for the supply of steam. A further steam pipe 28 leads to a nozzle 21, which provides steam generally to the interior of the enclosure 5. Preferably, the nozzle 21 is in the form of a horizontal pipe, shown in end view in FIG. 3, that extends along one bottom corner of the enclosure and is provided with a plurality of steam outlets along its length to eject steam in the direction shown. To circulate the steam, there is provided a generally vertical baffle plate 22, a plurality of centrifugal blowers 23 operated by motors 24, guide and distribution plates 25, and a heat exchanger 26. As a result the steam circulates in the path as indicated by the arrows. The heat exchanger 26 is preferably provided with automatic controls to maintain a temperature of approximately 400 degrees F. within the enclosure. As seen, the steam passes vertically down through the tunnels. Each of the tunnels is provided at its lower portion with a funnel shaped condensate collector. Condensate will drip from the bottom of the funnel portions 7 to the floor of the enclosure, which is sloped towards a central outlet 27, where there is a drain for removing the liquid condensate. Spent steam is removed, along with vaporized lubricating oils, spinning oils, anti-static agents, and other working fluids present within the yarn from adjacent the inlet end 15 by means of vertically extending exhaust pipes 30, one for each tunnel,, and from adjacent the outlet end 16 by means of vertically extending exhaust pipes 29, one for each tunnel. Each of the exhaust pipes has an inlet opening into its respective tunnel and an outlet. The exhaust pipes 29 are located within a single vertical plane, whereas the exhaust pipes 30 are located in a single vertical parallel plane. The outlets of the exhaust pipes 29 open into a preferably single horizontal manifold 31 located on top and to the exterior of the enclosure, and the exhaust pipes 30 have their outlets opening into a single horizontal vertical manifold 32. The manifolds 31 and 32 are basically pipes, preferably substantially larger in diameter than the exhaust pipes 29, 30, and they are parallel to each other. There are end walls closing each end of the manifolds 31, 32. A horizontally extending header pipe 33 connects the central portion of the manifolds 31, 32 and is in turn provided at its central portion with the inlet 34 of a centrifugal blower 35 provided with a motor 36. A main exhaust pipe 37 leads from the outlet of the blower 35 to a chimney 38.

Steam and vaporized working fluids travel vertically through the exhaust pipes 29, 30 to where they are collected within the manifolds 31 and 32, for further travel along the header pipes 33 to the inlet of the blower 35, under suction, from where they travel under pressure through the main exhaust pipe 37 to the chimney 38. Condensate that collects within the chimney 38 passes through a drain 39 for disposal, and for this purpose, the chimney 38 extends to a position lower than the main exhaust pipe 37 and is provided with a slanted bottom wall leading to the drain 39. With such an apparatus, the vaporized working liquids will condense on the various interior walls of the enclosure 5 and the interior surfaces of the pipes 29, 30, 31, 32, 33, 37 and 38, as well as the interior surfaces of the blower 35. Unavoidably, there are present broken airborn filaments throughout the entire yarn mill, and of course within the enclosure 5. These yarn filaments tend to collect on the same surfaces as the condensate, and at the high temperatures of the enclosure, the condensate tends to partially solidify and bake to form a mat that adheres tightly and permanently, unless removed, onto such interior surfaces. The mat resembles steel wool that has been used for the removal of a thick sticky substance.

Figure 4:
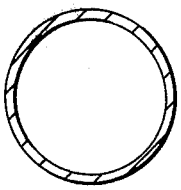
FIG. 4 is a cross sectional view of a pipe used in the apparatus in a clean condition, both prior to use of the apparatus and after the cleaning employed by the present invention.
Figure 5:
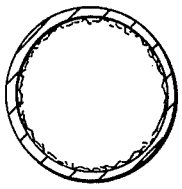
FIG. 5 is a cross sectional view of the same pipe as shown in FIG. 4, but after usage of the machine and immediately prior to the cleaning employed by the present invention.
Figure 6:
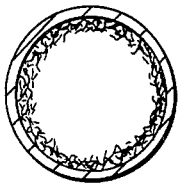
FIG. 6 is a cross sectional view of the same pipe as shown in FIGS. 4 and 5, but after extended use of the apparatus without employing the cleaning features of the present invention.

FIG. 4 shows a clean pipe, that could be any one of the pipes 29, 30, 31, 32, 33, 37 and 38 and even representative of the interior surfaces of the blower 35. As seen, the interior pipe surface is clean and the apparatus is constructed for optimum operation with such clean pipes. As shown in FIG. 5, the surface of the pipe is now coated with the mat-like substance discussed above, after one full 24 hour day of operation. The mat in FIG. 5, is just starting to affect the fluid flow characteristics appreciably. This effect will change the pressure drop within the pipes and correspondingly change the flow of steam through the pipes, and correspondingly affect the temperature within the enclosure, which can partly be adjusted for by means of the heat exchanger 26 or other temperature control, such as adjusting the amount of steam entering the enclosure 5. FIG. 6 represents the condition of the mat after one week of operation for some of the pipes, or after one month of operation for others of the pipes. The mat may reach a thickness of one inch and not only prevents the flow of fluid through the mat, but provides a rough surface that will interfere with flow even in the free portion of the pipe due to turbulence. In this condition of FIG. 6, the apparatus is not operating satisfactorily and has not operated satisfactorily for some time.

According to the present invention, nozzles are placed strategically throughout the above-mentioned piping system. Nozzles 40 are placed centrally in the end plates of each end of each manifold 31, 32, to spray a high pressure liquid axially in a symmetric pattern down the entire axial length of each manifold, from opposite axial directions. The central portion of each manifold is provided with a nozzle 40, axially aligned with the center of the header 33, to spray a symmetrical cone pattern of liquid under pressure axially down the header 33, from opposite directions. A nozzle 40 can also be placed in the lower portion of the exhaust pipes 29 and 30 to spray a cone of liquid chemical up each exhaust pipe. This can be achieved by plumbing similar to that schematically shown within the interior of the housing at appropriate locations with proper connections to the outside of the housing, or the pipes may be secured to the exterior of the machine and to the tunnel areas; this can be in addition to the spraying down the tunnels or as the only means to clean the tunnels 29 and 30, in the alternative. The top surface of each manifold 31, 32 is provided with a plurality, corresponding in number with the plurality of exhaust pipes 29, 30, of nozzles that are axially aligned with the central axis of respective exhaust pipes 29, 30, to spray a symmetrical cone shaped pattern of liquid axially down each exhaust pipe. A nozzle 40 is provided in the fan housing 35 to spray the chemical liquid into and down exhaust pipe 37 toward and out the exhaust housing or chimney 38. Also, a nozzle 40 is provided in the lower extreme of exhaust pipe 37 to spray a cone upward and out to clean the housing. A nozzle 40 is provided in steam line 19 to clean the interior of the steam jackets located in the inlet side of the steam envelope 20 that is positioned in each of the tunnels 8–13. A nozzle 40 is provided in steam line 28 to clean the interior of the nozzle 21 located in the enclosure 5. A nozzle 40 is provided in the chimney 38 axially aligned with the main exhaust pipe 37. The bottom surface of the header 33 is provided with a single nozzle 40 to spray upwardly and symmetrically into the blower 35. A piping system 41, which has been partially removed from the drawing to generally clarify the structure, is provided to feed high pressure liquid to each of the nozzles 40.

Figure 7:
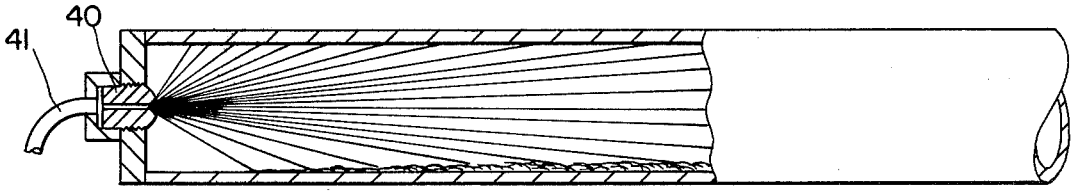
FIG. 7 is a view along the axis of a pipe used in the apparatus, showing the spraying of liquid solvent axially along the pipe, with the pipe being partly in cross section.

As shown in FIG. 7, each nozzle 40 sprays a pattern of liquid axially down its respective pipe, and FIG. 7 is representative of the operation of all the nozzles 40. The view of the spray pattern in FIG. 7 would be identical throughout the full 360 degree rotation of the plane of the cross section in FIG. 7 as rotated about the central axis of the pipe, that is the spray pattern is that of a solid cone that provides direct impingement of liquid on substantially all of the interior surfaces of the pipe. It is preferable to spray the liquid down the manifolds and header first in one direction, and then in the opposite direction, but sequencing the operation of the spray nozzles located at the opposite ends. The piping 41 leads back to a central control 42 that is schematically shown. This control contains a supply, preferably a reservoir, of cleaning liquid feeding a high pressure liquid pump that can deliver, for example 0.5 gallons per minute to 40 gallons per minute of the liquid. A plurality of valves are provided to control the delivery of the cleaning liquid to the various nozzles 40. With a low volume delivery pump, more valves are needed so that only a few of the nozzles are in operation at one time, whereas with a high volume delivery pump, less valves can be used for the common feeding of more nozzles.

Figure 9:
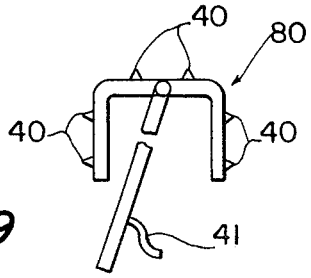
FIG. 9 is a perspective view of an apparatus for cleaning the tunnels.

To clean the interior of the tunnels 8–13, a portable apparatus is employed as shown in FIG. 9. Six spray nozzles that produce a flat spray pattern are used on a U-shaped wand 80 that is attached to a ¼ inch pipe, which pipe is in turn operatively coupled to a high pressure chemical solution supply line leading to the previously mentioned chemical supply. By mounting the U-shaped wand 80 on a beam 6 successively in each of the tunnels 8–13, and manually passing the wand back and forth throughout the full length of the tunnel, there is achieved a cleaning of the interior of the tunnels. This further helps clean the walls and pan of the lower portion of the apparatus shown in FIG. 5.

In a typical operation, the yarn treating apparatus would be operated for 24 continuous hours, and then at the changing of working shifts, one of the apparatus operators, not a specially trained maintenance person, could merely interrupt the passage of yarn through the apparatus, which would take less than one minute to accomplish, and then press a button or the like to sequence the above-mentioned valves and spray cleaning liquid through the pipes. This would dislodge the mat and wash the mat material downwardly for collection and discharge through the drain 27 and thereby clean the pipes from their condition shown in FIG. 5 to the condition shown in FIG. 4. This cleaning operation would only take approximately two minutes, with an additional minute perhaps being employed for restarting the yarn flow through the enclosure tunnels. It is preferable to conduct such cleaning operation quite frequently, to avoid the buildup of the mat and thereby to avoid the disadvantages noted above with respect to the buildup of the mat. In the beginning stages of the mat formation in FIG. 5, the material is easily removed, whereas when it reaches the stage of FIG. 6, it has been baked onto the interior surfaces over an extended period and is extremely difficult to remove.

In this manner, the pipes can be kept clean by machine operators that are already present for the operation of the machine, without the use of specially trained maintenance people. Further, the down time of the machines will only be approximately two to three minutes per day, rather than eight hours per week, and the condition of the machines will be greatly improved as compared with the prior manner of operation.

Figure 8:
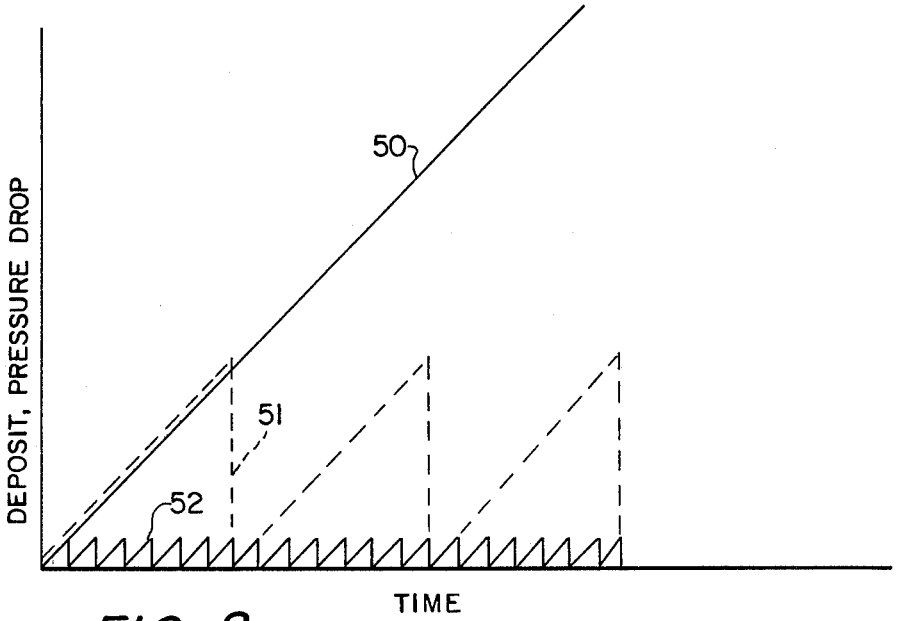
FIG. 8 is a graph comparing the present invention with the prior art.

As shown in FIG. 8, the line 50 represents, schematically, the buildup of the mat over a three week period, and the dotted line 51 represents the buildup of the mat over one week periods, with three cleaning operations according to the old manual cleaning method of disassembly being performed after each week. The sawtooth line 52 schematically represents the buildup of the mat and its periodic cleaning each day, over the three week period. The advantages of the present invention are readily apparent.

The cleaning liquid employed with the present invention may consist of a chemical and water solution, for example one part chemical and twenty parts water. The chemicals may consist of surfactants and a caustic agent. For example, the surfactant may be 2% of the total volume of the solution, and a satisfactory surfactant is a foam surfactant produced by Rohm and Haas, and identified as CF-32. The caustic agent may be a soda supplied as a powder or a 50% solution, and the soda constituting 10% of the entire cleaning solution. Therefore, it is preferable that the cleaning solution be a water-based detergent that is alkaline. The pressure of the solution passing from the pump to the nozzles may be between 300 p.s.i. and 2000 p.s.i., and preferably within the range of 650 to 1000 p.s.i. With the above-described embodiment, there are twenty nozzles, and with a low capacity pump, eleven valves could be used for supplying the liquid to these nozzles.

The control 42 can merely be a plurality of the above-mentioned valves that are manually operated in a desired pattern, for which the machine operator can be trained to accomplish. More desirably, a motor driven cam can be provided to either directly mechanically operate the valves, or indirectly operate the valves through microswitches and solenoid operators, all according to conventional valve automatic operation. In this manner, it would then be necessary only for the operator to push a switch to start the valve sequencing, which then would be completed automatically and predictably over a one to three minute period. Each of the nozzles is preferably mounted as shown in FIG. 7 by drilling and tapping a hole in the wall where it is to be mounted, and then screwing the externally threaded nozzle into such hole, and further providing a coupling between the nozzle and the supply pipe 41. This coupling is preferably a permanent connection, but the coupling could be a quick type snap coupling if the pipes 41 were flexible conduits.

It is further contemplated that the present invention may be accomplished with the use of long wands with a radially spraying nozzle at their end, which could then be axially and manually passed through various pipes, upon the removal of end closures for what would basically then be manually cleaning, but while maintaining all of the pipes in their assembled relationship and not requiring the prior art disassembly of such pipes. The wand would be provided with a flexible cleaning solution delivery line connected back to a suitable valve, pump and reservoir.

Further, it is contemplated that a plurality of nozzles 40 may be placed about the interior of the enclosure 5 for spraying the enclosure 5 and removing mat-like material that will adhere to the interior walls of the enclosure 5. However, the adherence of the mat to the interior walls of the enclosure is not such a problem as it is to the interior surface of the various pipes. The nozzles 40 for the enclosure may be operated in all of the manners discussed above.

Some of the advantages produced by the present invention are as follows:

The down time, or time that the machinery is not in operation is reduced from eight to four hours per week to two to three minutes per day.

Cleaning may be accomplished by the personnel who operate the machine, without employing special maintenance people for this purpose, whereas the prior art has employed trained maintenance people.

The machine operators are not idle while maintenance is being accomplished for machine cleaning.

The machine operates closer to design ideal standards, rather than having its operation gradually deteriorate throughout the week or month before the same is cleaned.

In general, operation is more economical and more reliable.

While a specific embodiment has been described in detail, with variations mentioned, further embodiments, variations and modifications are contemplated according to the broader aspects of the present invention, although there are specific advantages to the specific construction disclosed over and above the general advantages of the invention according to the broader aspects, all as determined by the spirit and scope of the following claims.

What is claimed is:

1. A machine for treating a plurality of indefinite length strands of yarn with steam, comprising:

an enclosure having heat transfer insulated walls, a top, and a bottom;

a treatment tunnel extending through said enclosure having an open inlet end and an open outlet end;

a beam extending entirely through said tunnel, having a support at one end outside of said tunnel and yarn support means providing an endless moving support surface on the exterior of said beam moving continuously from said inlet end to said outlet end;

means for coiling the strand yarn continuously on said moving support surface of said beams outside of said tunnel adjacent said inlet end so that an indefinite length coil of strand yarn will continuously move through said tunnel from said inlet end to said outlet end on said moving support surface of said beam;

means for uncoiling the strand yarn and removing it from said beam adjacent the outlet end of said tunnel and outside of said tunnel;

means for applying steam to said yarn while it is within said tunnel for heat treating the yarn and driving off previously applied yarn working liquids, such as oils and anti-static agents, to produce steam and vaporized working liquids within said tunnel;

drain means collecting liquid, including condensed working liquid vapors from said tunnel and said enclosure at the bottom of said enclosure and removing said liquid from said enclosure;

at least a first exhaust pipe having an inlet adjacent the inlet end of said tunnel and an outlet exteriorly of said enclosure;

a second exhaust pipe having an inlet adjacent said tunnel outlet end and an outlet exteriorly of said enclosure;

a plurality of said tunnels, beams, and first and second exhaust pipes, coiling means, and uncoiling means associated with said enclosure and generally respectively parallel to each other for processing a corresponding plurality of yarn strands, with said drain means being common;

a plurality of manifold pipes extending generally perpendicularly to said exhaust pipes and opening into each outlet end of said exhaust pipes;

a main exhaust pipe;

at least one blower having an inlet and having an outlet operatively connected to said main exhaust pipe;

header means extending respectively between said manifold pipes and said blower inlet for sucking said vapors and steam from said manifold pipes that has passed through said exhaust pipes and delivering said steam and vapors to said blower for passage through said main exhaust pipe;

all of said means, beams, pipes, tunnels, enclosure and blower causing said vapors to at least partially condense and solidify along with yarn filaments, unavoidably breaking away from said yarn and becoming airborn during yarn processing, onto the interior surface of said exhaust pipes, manifold pipes, header means, blower and main exhaust pipe to thereby progressively reduce the interior through flow cross sectional area of said pipes, header means, and blower substantially to change their fluid flow characteristics and tend to change the temperature values and temperature distribution within said enclosure;

means for adjusting the steam flow into said tunnels and the temperature of said tunnels to compensate for said changing flow characteristics so as to maintain a generally constant temperature within said tunnel;

a plurality of nozzle means, corresponding in number to the number of said first and second exhaust pipes, for receiving a high pressure liquid solvent and spraying a cone of the liquid solvent axially along said first and second exhaust pipes from their outlets to their inlets and into said tunnels to contact the liquid with substantially the entire interior surfaces of said first and second exhaust pipes;

at least one nozzle means mounted at an axial end of each of said manifold pipes for receiving a high pressure liquid solvent and spraying the liquid solvent in a cone axially along the interior surface of said manifold pipes to contact the liquid with substantially the entire interior surfaces of said manifold pipes;

means for supplying high pressure liquid solvent to each of said nozzle means; and control means for periodically shutting down operation of said blower and providing high pressure liquid solvent to said nozzle means for said first and second exhaust pipes and said manifold pipes so that the supplied liquid solvent will clean the interior surface of the same and thereby provide a mixture of liquid solvent, removed filaments and removed partially solidified condensate to flow through said drain means.

2. The apparatus of claim 1, wherein said nozzle means for said first and second exhaust pipes are respectively mounted on said manifold pipes.

3. The apparatus of claim 1, wherein said control means include valve means and automatic timed control means to sequence the supply of high pressure liquid solvent to said nozzle means so that high pressure liquid solvent is supplied to said first and second exhaust pipes and manifold pipes only when said blower is inoperative.

4. The apparatus of claim 1, further including a plurality of nozzle means distributed throughout the interior of said enclosure for spraying the interior walls of said enclosure with liquid solvent.

5. The apparatus of claim 1, wherein each of said nozzle means sprays a pattern of a solid cone.

6. The apparatus of claim 1, including nozzle means mounted in said header means for receiving a high pressure liquid solvent and spraying the liquid solvent along the interior surface of said header means.

7. The apparatus of claim 6, including nozzle means mounted for receiving high pressure liquid solvent and spraying the liquid solvent into said blower during operation of said blower to contact the interior surface of said blower and said main exhaust pipe with liquid solvent.

8. A method for treating a plurality of indefinite length strands of yarn with steam, comprising:

providing an enclosure having heat transfer insulated walls, a top, and a bottom;

a treatment tunnel extending through said enclosure having an open inlet end and an open outlet end;

providing a beam extending entirely through said tunnel, having a support at one end outside of said tunnel and means providing an endless moving support surface on the exterior of said beam moving continuously from said inlet end to said outlet end;

coiling the strand yarn continuously on said moving support surface of said beam outside of said tunnel adjacent said inlet end so that an indefinite length coil of strand yarn will continuously move through said tunnel from said inlet end to said outlet end on said moving support surface of said beam;

uncoiling the strand yarn and removing it from said beam adjacent the outlet end of said tunnel and outside of said tunnel;

applying steam to said yarn while it is within said tunnel for heat treating the yarn and driving off previously applied yarn working liquids, such as oils and anti-static agents, to produce steam and vaporized working liquids within said tunnel;

collecting liquid, including condensed working liquid vapors from said tunnel and said enclosure at the bottom of said enclosure and removing said liquid from said enclosure;

providing at least a first exhaust pipe having an inlet adjacent the inlet end of said tunnel and an outlet exteriorly of said enclosure;

providing a second exhaust pipe having an inlet adjacent said tunnel outlet end and an outlet exteriorly of said enclosure;

providing a plurality of said tunnels, beams, and first and second exhaust pipes, associated with said enclosure and generally respectively parallel to each other and thereby coiling, uncoiling and steam processing a corresponding plurality of yarn strands, with collecting and steam applying being common;

providing a plurality of manifold pipes extending generally perpendicularly to said exhaust pipes and opening into each outlet end of said exhaust pipes;

providing a main exhaust pipe;

providing at least one blower having an inlet and having an outlet operatively connected to said main exhaust pipe;

sucking said vapors and steam from said manifold pipes that has passed through said exhaust pipes and delivering said steam and vapors to said blower for passage through said main exhaust pipe;

said vapors at least partially condensing and solidifying along with yarn filaments, unavoidably breaking away from said yarn and becoming airborn during yarn processing, onto the interior surface of said exhaust pipes, manifold pipes, blower and main exhaust pipe to thereby progressively reduce the interior through flow cross sectional area of said pipes, and blower substantially to change their fluid flow characteristics and tend to change the temperature values and temperature distribution within said enclosure;

adjusting the steam flow into said tunnels and the temperature of said tunnels to compensate for said changing flow characteristics so as to maintain a generally constant temperature within said tunnel;

employing a plurality of nozzle means, corresponding in number to the number of said first and second exhaust pipes, for receiving a high pressure liquid solvent and spraying a cone of the liquid solvent axially along said first and second exhaust pipes from their outlets to their inlets and into said tunnels to contact the liquid with substantially the entire interior surfaces of said first and second exhaust pipes;

employing at least one nozzle means mounted at an axial end of each of said manifold pipes for receiving a high pressure liquid solvent and spraying the liquid solvent in a cone axially along the interior surface of said manifold pipes to contact the liquid with substantially the entire interior surfaces of said manifold pipes;

employing nozzle means mounted in said header means for receiving a high pressure liquid solvent and spraying the liquid solvent along the interior surface of said header means;

supplying high pressure liquid solvent to each of said nozzle means; and periodically shutting down operation of said blower and providing high pressure liquid solvent to said nozzle means for said first and second exhaust pipes and said manifold pipes so that the supplied liquid solvent will clean the interior surfce of the same and thereby providing a mixture of liquid solvent, removed filaments and removed partially solidified condensate to said step of collecting and removing.

9. The method of claim 8, further including the steps of discontinuing said coiling, uncoiling, sucking, applying steam and operation of said blower during said steps of employing, and supplying and providing high pressure liquid solvent.

10. The method of claim 9, wherein said step of adjusting maintains a temperature of approximately 400 degrees F.

11. The method of claim 10, including the further steps of operating said blower and providing liquid solvent to said blower intake for cleaning said blower and said main exhaust pipe immediately after said steps of employing and providing high pressure liquid solvent, but before continuing said steps of coiling, uncoiling, and applying steam.

12. The method of claim 8, wherein said solvent is supplied as a water solution of surfactant and caustic agents.

13. A method for treating an indefinite length strand of yarn with steam, comprising:

coiling the strand yarn continuously on a support surface and moving the coiled strand yarn through a steam heated enclosure to drive off previously applied yarn working liquids as a vapor, withdrawing the coiled yarn from the enclosure and uncoiling the steam treated strand yarn;

depositing condensate of said vapor along with airborn strand and filament pieces of the yarn on the interior surfaces of the enclosure thereby forming a progressively increasing thickness mat on the interior surfaces;

periodically discontinuing said steps of coiling, uncoiling, and applying steam, and removing all strand yarn from the enclosure, and thereafter spraying the interior surfaces of the enclosure that have the greatest buildup of the mat with a liquid solvent thereby substantially removing the mat from the sprayed interior surfaces, without disassembling the sprayed interior surfaces;

thereafter continuing said steps of coiling, uncoiling, and applying steam for further steam treatment of yarn.

14. The method of claim 13, including the step of maintaining the temperature within the enclosure at approximately 400 degrees F. during steam treatment of the yarn.

15. The method of claim 14, including automatically sequentially spraying different interior surfaces of the enclosure with the liquid solvent in a fixed sequence.

16. The method of claim 13, wherein said solvent is supplied as a water solution of surfactant and caustic agents.

17. The method of claim 13, wherein said steps of spraying are conducted for only a few minutes at least once each day of 24 hour a day operation of the yarn stem treatment.

* * * * *